United States Patent [19]

Maruska

[11] 3,965,821

[45] June 29, 1976

[54] LOW SPIN-DECELERATION SAFING AND ARMING MECHANISM

[75] Inventor: William O. Maruska, Minnetonka, Minn.

[73] Assignee: The United States of America as represented by the Secretary of the Air Force, Washington, D.C.

[22] Filed: Jan. 16, 1975

[21] Appl. No.: 541,484

Related U.S. Application Data

[63] Continuation-in-part of Ser. No. 392,379, Aug. 28, 1973, abandoned.

[52] U.S. Cl. ..... 102/79

[51] Int. Cl.[2] ..... F42C 15/22

[58] Field of Search ..... 102/79, 80, 71

[56] References Cited

UNITED STATES PATENTS

| | | | |
|---|---|---|---|
| 3,371,608 | 3/1968 | Webb | 102/79 X |
| 3,583,319 | 6/1971 | James | 102/80 |
| 3,587,469 | 6/1971 | Gratton et al. | 102/79 |
| 3,724,384 | 4/1973 | Donahue | 102/79 |
| 3,730,101 | 5/1973 | Schultz | 102/79 |

*Primary Examiner*—David H. Brown
*Attorney, Agent, or Firm*—Joseph E. Rusz; Arsen Tashjian

[57] ABSTRACT

A safing and arming mechanism which is adapted for use with a mechanical fuze, and which is armed only after having been subjected to the combined and total effects of a spin environment and of an aerodynamic deceleration environment, with the existence of the environments being either separate or simultaneous. The mechanism includes a rotor and a rotor spring which will arm the mechanism only at a higher static spin rate than a lockweight component of the mechanism. Because of a delay disc-lockweight interlock structural feature, the complete arming sequence of the mechanism is prevented until the necessary spin and deceleration environments exist. When this environmental combination is achieved, the lockweight moves before the rotor can return; and, that results in the release of the rotor and the arming of the mechanism.

3 Claims, 5 Drawing Figures

LOW SPIN-DECELERATION SAFING AND ARMING MECHANISM

STATEMENT OF GOVERNMENT INTEREST

The invention described herein may be manufactured and used by or for the Government for governmental purposes without the payment of a royalty thereon.

CROSS REFERENCE TO RELATED APPLICATION

This application is a continuation-in-part of copending U.S. Patent application No. 392,379, filed on Aug. 28, 1973 and now abandoned.

BACKGROUND OF THE INVENTION

This invention relates to mechanical fuzes and, more particularly, to a safing and arming mechanism for a mechanical fuze which is adapted for use in a bomb or the like, such as a submunition, which spins while in flight.

It is axiomatic in the fuze art that a fuze should be certain in action, safe in handling and using, free from deterioration in storage, simple in design and operation, and easy to manufacture and load. However, the known prior art establishes that, primarily because some of these requirements are conflicting (such as, safety features tending to complicate the design, and thereby increasing the difficulty of manufacture), the "ideal" fuze, especially of the mechanical type, has not as yet been attained. Further, due to the advent and to the use (potential or actual) of submunitions systems, there exists a genuinely critical current need for a mechanical fuze and/or safing and arming mechanism thereof which, in addition to the above mentioned requirements, can also uniquely combine and utilize the effects of two environments (i.e., spin, and aerodynamic drag deceleration) to "fast arm" the fuze. These additional requirements are imposed because submunitions (or "bomblets," as they sometimes are referred to), which are conventionally of the autorotating type, and which also are traditionally and preferably of the spherically configurated type, are designed for dispensing or introduction into the airstream at a predetermined height above the ground and/or target. The selected height is of necessity, sufficiently above the ground (or target) so as to allow enough time for the aerodynamic forces to spin the spherical (and usually fluted) configurated submunition(s) to the preselected arming spin rate. During this time the drag deceleration force also acts upon the submunition(s).

I have invented a safing and arming mechanism which meets the above-mentioned requirements and fulfills the present pressing need in the mechanical fuze art. Thereby, I have significantly advanced the state-of-the-art. In addition, my inventive mechanism has the added important advantages of: (1) requiring a dynamic arming spin that is materially lower than the static (or bench) arming spin rate, thereby providing increased handling safety; and (2) arming only as the result of the combined effects of exposure to the spin and to the aerodynamic drag deceleration environments, irrespective of whether said combined effects are simultaneous or separate (i.e., sequential).

SUMMARY OF THE INVENTION

My invention is a novel low spin and deceleration safing and arming mechanism for a mechanical fuze adapted for use in a submunition.

The principal object of my inventive mechanism is to provide a novel and unique safing and arming mechanism which will advantageously combine the total effects of a spin environment and of an aerodynamic deceleration environment to actuate and to accomplish "fast arming" (i.e., the armed condition or phase).

Another object of my inventive mechanism is to permit "fast arming" of the mechanism at a materially lower dynamic spin rate than the static spin rate.

Still another object of my inventive mechanism is to allow "fast arming" of the mechanism irrespective of whether the combined effects of the spin and of the aerodynamic drag deceleration environments are simultaneous or dual (i.e., separate).

These objects, and still other related and equally important objects, of my inventive mechanism will become readily apparent after a consideration of the description of my invention, coupled with reference to the drawing.

DESCRIPTION OF THE PREFERRED EMBODIMENT

Figure 1:
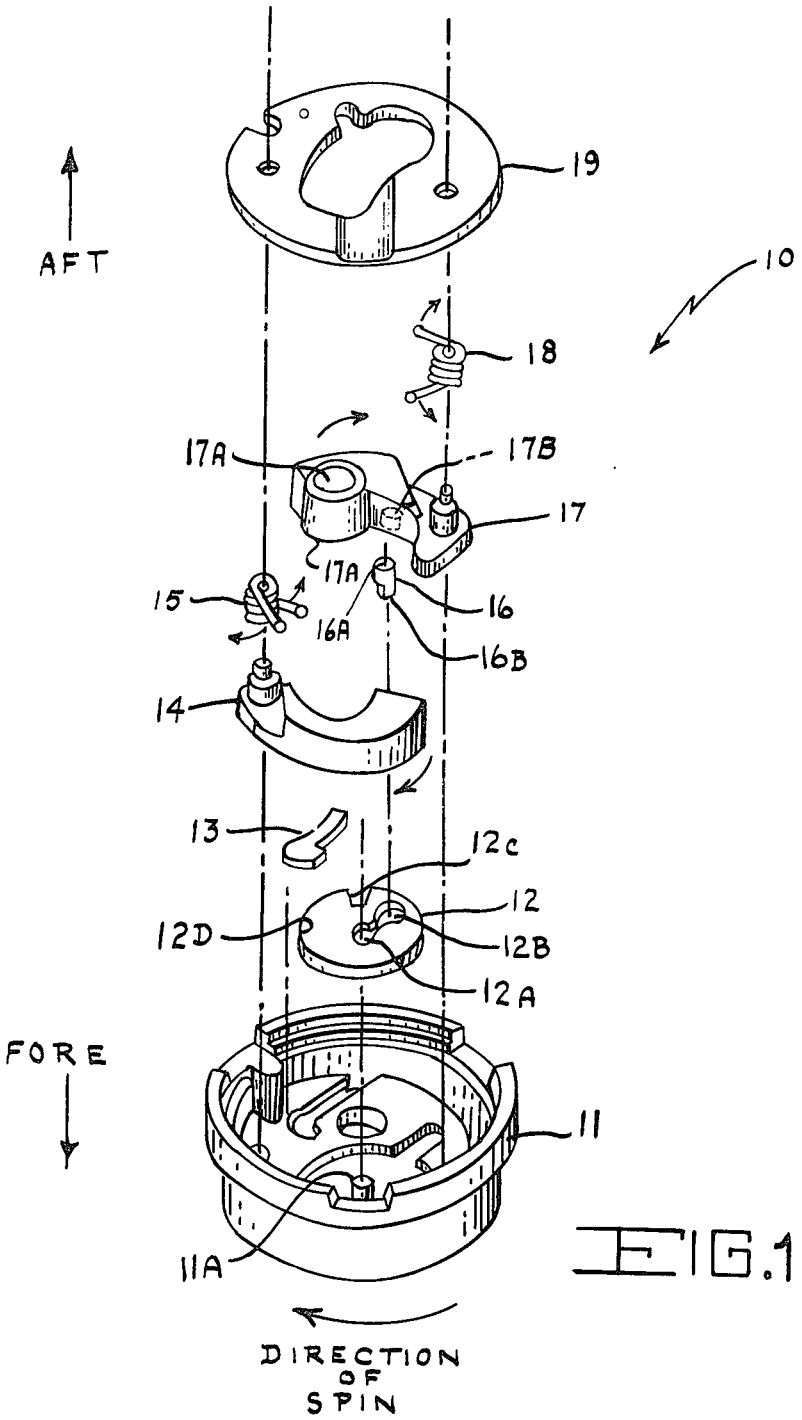
FIG. 1 is an exploded view in perspective of a preferred embodiment of my inventive mechanism, with directional arrows showing the fore and aft ends of the mechanism and also showing the assumed direction of spin of said mechanism; and, FIGS. 2–5, inclusive, are top plan view, in simplified form and partially fragmented, of my inventive mechanism during the following sequential phases or conditions of operation: safe (FIG. 2); initial rotor movement (FIG. 3); rotor release (FIG. 4); and, armed (FIG. 5).

With reference to FIG. 1 in which is shown an exploded view of a preferred embodiment 10 of my inventive mechanism, it is to be noted as a preliminary matter that the designated (or assumed) direction of spin of the mechanism is to be understood as being the conventional art-accepted spin direction (i.e., clockwise), and is not intended to be a limitation imposed by the structure of my mechanism.

Still with reference to FIG. 1, the preferred embodiment 10 includes: a housing 11 having a boss 11A; a delay disc 12 with an aperture 12A configurated and dimensioned to accept housing boss 11A, and with a slot 12B therethrough, and also with a notch 12C therein at the periphery thereof 12 D which, when positioned within housing 11, is linked in a rotationally mounted manner to said housing 11; a rotor latch 13 which, when positioned within housing 11, is also linked to the housing 11; a lockweight 14 which, when positioned within housing 11, is linked to the housing 11 and further is aft (i.e., above) the positioned delay disc 12; means for biasing the lockweight 14, such as spring 15 (hereinafter referred to as the "safety spring"), within housing 11; a rotor interlock pin 16 with fore end 16B and aft end 16A, with aft end 16 B configurated and dimensioned to fit into, and to move within, slot 12B of delay disc 12 which said pin 16 is linked to delay disc 12 when it 16 is positioned within housing 11; a rotor 17 having an aperture 17A therein and therethrough for carrying and containing a detonator (not shown) and also having a hole 17B therein to accept in a press fit condition the aft end 16A of rotor interlock pin 16, with rotor 17 linked to rotor interlock pin 16 when both the rotor 17 and the pin 16 are positioned within housing 11; means for biasing the rotor 17, such as spring 18 (hereinafter referred to as the "rotor spring"), within housing 11; and, a bearing plate 19 positioned aft (i.e., above) the delay disc 12, the rotor latch 13, the lockweight 14, the lockweight biasing means (i.e., safety spring 15), the rotor interlock pin 16, the rotor 17, and the rotor biasing means (i.e., rotor spring 18), with the bearing plate 19 linked to and positioned within housing 11. It is to be noted that rotor spring 18 and safety spring 15 are biased outwardly, as indicated by the directional arrows.

Figure 3:
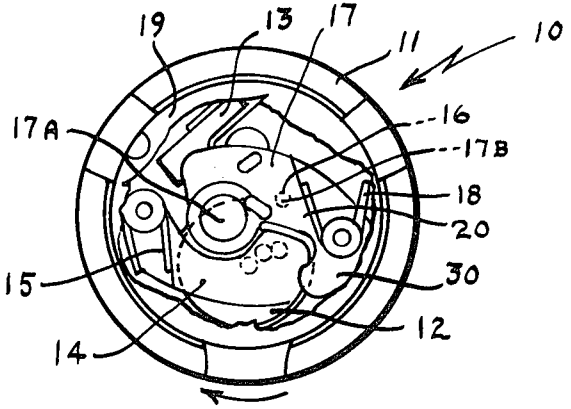
Figure 5:
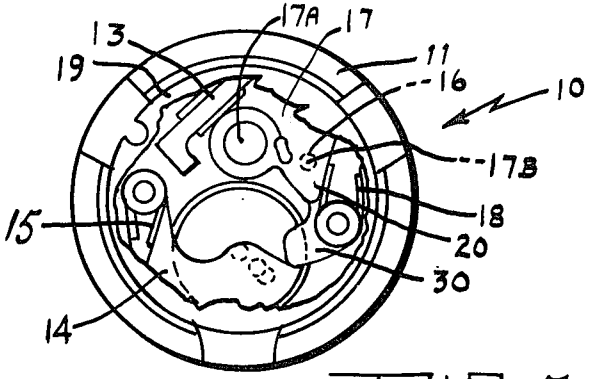
Figure 2:
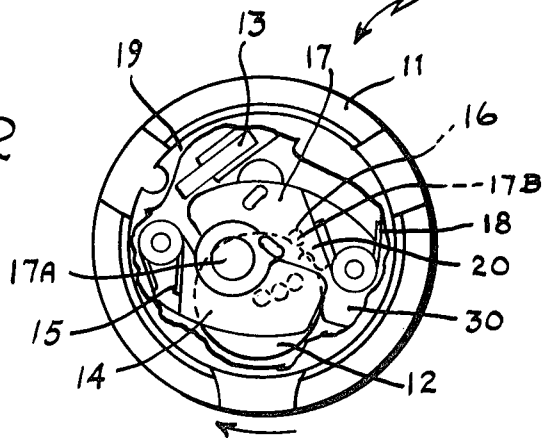
Figure 4:
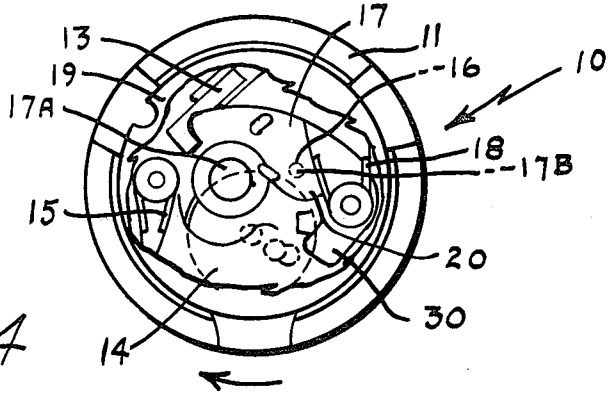

With reference to FIGS. 2–5, inclusive, therein are shown the four principal phases of the arming sequence, and the movement and relative positioning after said movement of the interdependent cooperative components, of the preferred embodiment 10 of my inventive safing and arming mechanism. These phases or conditions of operation are: safe, as shown in FIG. 2; initial rotor movement, as shown in FIG. 3; rotor release, as shown in FIG. 4; and, the armed condition, as shown in FIG. 5. It is here to be noted that the same components of the preferred embodiment 10, as shown in FIGS. 2–5 (inclusive), have the same reference numerals as assigned to them, and as shown, in FIG. 1. It is also here to be noted that, as shown in FIG. 2, the preferred embodiment 10 of my inventive mechanism has: a delay disc 12-lockweight 14 "interlock assembly," generally designated 20; and, a rotor 17 "interlock assembly," generally designated 30. These "interlocks" 20 and 30 are significant additional inventive features of the preferred embodiment 10 disc-lockweight my invention. The delay disclockweight "interlock" 20 includes the rotor interlock pin 16 and the delay disc 12. The rotor "interlock" 30 includes the rotor 17 and the lockweight 14. These two "interlocks" 20 and 30 limit movement of either the rotor 17 or the lockweight 14 during impact, and thereby provide handling safety. Also shown in FIGS. 2–5 (inclusive) is the direction of spin (i.e., clockwise) of the preferred embodiment 10 as viewed from the aft end (i.e., above the embodiment 10).

MANNER OF OPERATION OF THE PREFERRED EMBODIMENT

The manner of operation of the preferred embodiment 10 of my inventive mechanism is very easily understood by a person of ordinary skill in the art from the foregoing description, coupled with reference to FIGS. 1–5, inclusive.

Succinctly, the arming sequence is specifically shown in FIGS. 2–5, inclusive. With reference to the aforesaid four Figures, when in the "safe" (or unarmed) condition, the detonator (not shown) which is housed in the rotor 17 (in aperture 17A) is held out-of-line with respect to the firing pin (not shown) on the one side, and the explosive train (not shown) on the other side, of the detonator carried and contained in rotor aperture 17A. Before arming can occur at the preselected spin rate, the mechanism 10 must be subjected to the effects of the two combined environments of spin and of deceleration. The rotor 17 and rotor spring 18 will arm only at a higher static spin rate than the lockweight 14. This prevents the complete arming sequency from occuring, because of the delay disc-lockweight "interlock" feature 20. However, when the necessary spin environment and the necessary deceleration environment exist, deceleration forces aid initial rotor movements to remove the delay disc-lockweight "interlock" 20. In addition, this initial movement shifts the rotor 17 center of gravity, so that the spin has a greater influence. As the mechanism 10 rotates, the deceleration force moves the lockweight 14 radially outward. When the proper balance between spin and deceleration is attained, the lockweight 14 moves before the rotor 17 can return, which then results in the release and the arming of the rotor 17. It is again noted and emphasized that these dynamic effects on arming spin rate are significantly lower than the static spin rate.

It is also to be noted that rotor interlock pin 16 moves when rotor 17 moves; and, that this movement of pin 16 causes the notched portion 12C of disc 12 to move.

CONCLUSION

It is clear from all of the foregoing, and from the drawings herein, that the desired objects of my inventive mechanism have been attained.

It is also emphasized that, although there have been described and shown the fundamental unique features of my invention, as applied to a preferred embodiment 10 adapted for a particular use, it is to be understood that various other embodiments, substitutions, additions, omissions, adaptations, and the like can be made by those of ordinary skill in the art, without departing from the spirit of my invention.

What I claim is:

1. A low spin and deceleration safing and arming mechanism adapted for use in the autorotating submunition comprising:

a. a housing;
b. a delay disc linked to, and positioned within, said housing;
c. a rotor latch linked to, and positioned within, said housing;
d. a lockweight linked to, and positioned within, said housing, with said lockweight disposed aft of said delay disc;
e. means for biasing said lockweight, with said means positioned within said housing;
f. a rotor interlock pin linked to said delay disc and positioned within said housing;
g. a rotor linked to said rotor interlock pin and positioned within said housing, with said rotor having an aperture therein and therethrough for carrying and containing a detonator;
h. means for biasing said rotor, with said means positioned within said housing;
i. and, a bearing plate positioned aft of said delay disc, said rotor latch; said lockweight, said lockweight biasing means, said rotor interlock pin, said rotor, and said rotor housing means, with said bearing plate linked to, and positioned within, said housing.

2. The safing and arming mechanism, as set forth in claim 1, wherein said lockweight biasing means is a spring.

3. The safing and arming mechanism, as set forth in claim 1, wherein said rotor biasing means is a spring.

* * * * *